US006295793B1

(12) United States Patent
Takayanagi

(10) Patent No.: US 6,295,793 B1
(45) Date of Patent: Oct. 2, 2001

(54) DIE ROLLS OF A SOFT CAPSULE MANUFACTURING APPARATUS AND A METHOD OF MANUFACTURING SOFT CAPSULES USING THE SAME

(75) Inventor: Tetsuo Takayanagi, Tokyo (JP)

(73) Assignee: Kabushiki Kaisha Kamata, Tokyo (JP)

( * ) Notice: Subject to any disclaimer, the term of this patent is extended or adjusted under 35 U.S.C. 154(b) by 0 days.

(21) Appl. No.: 09/246,248

(22) Filed: Feb. 8, 1999

(30) Foreign Application Priority Data

Feb. 9, 1998 (JP) ..... 10-042911

(51) Int. Cl.[7] ..... B65B 47/00
(52) U.S. Cl. ..... 53/454; 53/560
(58) Field of Search ..... 53/454, 453, 559, 53/560, 561

(56) References Cited

U.S. PATENT DOCUMENTS 4,571,924 * 2/1986 Bahrani .
4,899,519 * 2/1990 Williams et al. .
5,146,730 * 9/1992 Sadek et al. .
5,265,401 * 11/1993 Gujer et al. .
5,459,983 * 10/1995 Sadek et al. .
5,761,886 * 6/1998 Parkhideh .

* cited by examiner

*Primary Examiner*—Eugene Kim
(74) *Attorney, Agent, or Firm*—Flynn, Thiel, Boutell & Tanis, P.C.

(57) ABSTRACT

An apparatus and method for manufacturing soft capsules wherein a filling material, such as liquid medicine, is encapsulated by two gelatin sheets. The soft capsule manufacturing apparatus includes a pair of die rolls that are close to and confront each other, each die roll having capsule pockets in a plurality of rows, and a nozzle segment having an inverse projection for supplying a filling material. The inverse projection has curved faces that are positioned in opposing relation with each other at right and left sides about the lower end central portion thereof the curved faces have nozzle holes. The inverse projection confronts a curved recess that is surrounded by curved peripheral surfaces of the die rolls at the upper sides thereof. The gelatin sheets are supplied between the die rolls from the upper portion thereof to receive the filling material therein corresponding to the capsule pockets of each die roll to manufacture soft capsules. The nozzle holes are arranged on the curved faces in a plurality of rows corresponding to the capsule pockets provided on the die rolls in a plurality of rows. With this arrangement, when the pump is actuated one time, the filling material is supplied from the nozzle holes arranged in a plurality of rows to the capsule pockets arranged in a plurality of rows, leading to an increase in the production of capsules.

12 Claims, 13 Drawing Sheets

DIE ROLLS OF A SOFT CAPSULE MANUFACTURING APPARATUS AND A METHOD OF MANUFACTURING SOFT CAPSULES USING THE SAME

BACKGROUND OF THE INVENTION

1. Field of the Invention

The invention relates to die rolls of a soft capsule manufacturing apparatus and a method of manufacturing soft capsules using the same wherein a filling material such as liquid medicine is encapsulated by two pieces of gelatin sheet.

2. Description of Related Art

Soft capsules are generally manufactured by a manufacturing apparatus as illustrated in FIG. 10.

The manufacturing apparatus includes a pair of die rolls 10, 10 that are close to and confront each other, a nozzle segment 20 that supplies a filing material and is formed of an inverse mountain-like projection 21 having curved faces that are positioned in confronting relation with each other at right and left sides about the lower end central portion thereof, wherein the projection 21 confronts and is engaged in a curved recess S1 that is formed by surrounding curved peripheral surfaces of the die rolls 10, 10 at the upper sides thereof, and a supply hopper 30 located at the uppermost end thereof.

There are a distributor (dispersion plate) 41 for distributing the filming material, a slide valve mechanism 42 for controlling the supply of the filling material by sliding operation, a tube assembly plate 43 on which pipes for connection with a plurality of tubes are provided upright, and a plunger type pump 50 (hereinafter referred to simply as a pump 50) having a plurality of cylinders, that are respectively interposed between the nozzle segment 20 and the supply hopper 30 in the ascending order, and wherein the plurality of tubes (hoses) 61 for supplying the filling material threrethrough that are provided between the plurality of cylinders of the pump 50 and the tube assembly plate 43. Further, there are provided a return tube (hose) 62 that is interposed between the distributor 41, the slide valve mechanism 42 and the supply hopper 30, for returning the filling material that becomes useless, strip rolls 71, 71 for separating a pair of soft capsules that are provided under and appropriately away from the die rolls 10, 10, and a pair of mangle rolls 72, 72 which draw the pair of gelatin sheets.

When manufacturing the soft capsules, two gelatin sheets 100, 100 are supplied between the pair of rotating die rolls 10, 10 from the upper side thereof at the right and left sides thereof, and the filing material such as liquid medicine is filled in the supply hopper 30, wherein the filling material is supplied to a plurality of nozzle holes 22 that are arranged in one row in a longitudinal direction of the right and left curved faces of the inverse mountain-like projection 21 of the nozzle segment 20 at portions close to the lower end edge (or at the lowermost end edge) through the tubes 61, the tube assembly plate 43, the slide valve mechanism 42 and the distributor 41 when the pump 50 is actuated.

As a result, a plurality of capsule pockets 11 that are provided on the outer peripheral surfaces of the die rolls 10, 10 and arranged axially in a row occupy the nozzle holes 22 of the nozzle segment 20 while they are rotated, and hence the filling material is temporarily stored inside two gelatin sheets 100, 100, and they are conveyed downward with the rotation of the die rolls 10, 10. The gelatin sheets 100, 100 are brought into intimate contact with each other in a moment when the filling material passed through the narrowest part between the die rolls 10, 10, and they are cut and brought into intimate contact with each other under pressure at the same time when the annular blades that are formed at the peripheries of the capsule pockets 11 of the die rolls 10, 10 mesh with each other, so that intended soft capsules 200 are formed.

The thus formed soft capsules 200 that remain stuck to the capsule pockets 11 of the die rolls 10, 10 are stripped off by a brush or the like while the soft capsules 200 that remain stuck to a remaining gelatin sheet 101 formed by bonding two gelatin sheets 100, 100 are separated by the pair of strip rolls 71, 71, and also the remaining gelatin sheet 101 is drawn downward by the pair of mangle rolls 72, 72.

The soft capsules are instantaneously manufactured in practice, wherein the setting of the discharging accuracy of the filling material from the nozzle holes 22 of the nozzle segment 20 and of the timing such as rotation of the die rolls 10, 10 become very important If the discharging accuracy and the timing such as rotation are poorly set, the amount of the filling material filled in the soft capsules 200 is varied or the gelatin sheets 100, 100 are poorly bonded to each other or there occurs the deformation of the shape of the soft capsules 200.

Accordingly, there has been generally employed a pump as the pump 50 shown in FIG. 11, wherein the pump includes a plurality of cylinders 51*a*, 5l*b* (respectively five cylinders in this example) that are arranged symmetrically at right and left. Either of the cylinders 51*a*, 51*b* corresponds to each nozzle hole 22 of the nozzle segment 20 so as to secure the discharging accuracy, and a timing between the actuating or driving speed of the pump 50 and the rotational speed of the die rolls 10, 10 is accurately provided or set using a timing gear or the like.

For example, a concrete filling state is explained with reference to a case using the plunger 50 shown in FIG. 10, the typical nozzle segment 20 having five nozzle holes 22*a* to 22*e* as shown in FIGS. 12 and 13, and a typical right die roll 10 (left die roll 10 is omitted in FIG. 13) having three capsule pockets 11*a*, 11*b* and 11*c* that are arranged along the row denoted by the line A—A and two capsule pockets 11*a* and 11*b* are arranged along the row denoted by the line B—B wherein these capsule pockets are repeatedly provided in the circumferential direction.

When the filling material is filled in the three capsule pockets 11*a*, 11*b* and 11*c* that are arranged in the row denoted by the line A—A, all the cylinders 51*b* provided at the right side of the pump 50 are actuated, while when the filling material is discharged, the nozzle holes 22*a*, 22*c* and 22*e* of the nozzle segment 20 corresponding to the capsule pockets 11*a*, 11*b* and 11*c* are used, whereas the filling material corresponding to the nozzle holes 22*b* and 22*d* is returned to the supply hopper 30 through the distributor 41, the slide valve mechanism 42 and the return tube 62.

Meanwhile, when the filling material is filled in the next two capsule pockets 11*a* and 11*b* that are arranged in the row denoted by the line B—B, all the cylinders 51*b* provided at the right side of the pump 50 are actuated, while when the filling material is discharged, the nozzle holes 22*b* and 22*d* of the nozzle segment 20 corresponding to the two capsule pockets 11*a* and 11*b* are used, whereas the fling material corresponding to the nozzle holes 22*a*, 22*c* and 22*e* are returned to the supply hopper 30 through the distributor 41, the slide valve mechanism 42 and the return tube 62. Such a filling operation is simultaneously operated at the left side of the die roll 10.

Such a discharging process is sequentially repeated by the rotation of the die rolls 10, 10 so as to form intended soft capsules 200.

The standard of the die roll 10 that is practically used is shown in FIGS. 14 to 16. The diameter of each row is 102.8 mm and the length of the axis of each roll is 152.5 mm. The length of the axis of each roll is divided by 29, and the number of capsule pockets (3 rows+2 rows=5 rows) becomes 145. There are defined small gaps 61 and 62 between annular blades 12, 12 formed around the capsule pockets 11 (respective capsule pockets 11*a*, 11*b*, 11*c* and the capsule pockets 11*a* and 11*b*) and projections 13, 13 at the right and left ends of the die roll for pressing the edges of the gelatin sheets. Denoted by 61 is the gap defined between the blades 12 and 12 in the circumferential direction and it is 1.33 mm, and 62 is the interval between the blades 12 and 12 in the axial direction and it is 2.7 mm. The width of each blade is 1.0 mm, and the height of the each blade is 0.85 mm.

However, there are following problems in the conventional apparatus for and a method of manufacturing soft capsules, die rolls 10, 10

(1) Although it is preferable that there are many capsule pockets 11 are provided on the die rolls 10, 10, for example, in the case of the die roll having the standard shown in FIGS. 14 to 16, the gaps 61 and 62 are defined between the blades 12 of the capsule pockets 11, leading to the limits in the increase of the number of the capsule pockets 11.

(2) Since there are defined the gaps 61 and 62 between the blades 12, the remaining gelatin sheet 101 is generated as a matter of course. The amount of the remaining gelatin sheet relative to all the amount of the gelatin sheets 100, 100 is normally 35 to 45%. This causes a troublesome problem that the gelatin is inevitably wasted, and it takes a wasting cost, and finally it causes environmental pollution.

(3) Further, the remaining gelatin sheet 101 causes a machine trouble because it becomes a net-shape and it is eventually wound around the die rolls 10, 10 and also around the strip rolls 71, 71 and the mangle rolls 72, 72 that are provided under the die rolls 10, 10, leading to the hindrance of the stable operation.

(4) Meanwhile, it is possible to increase the rotational speed of each die roll to increase the volume of production. However, the driving speed of the pump 50 interlocked with the die roll 10 should be increased to increase the rotational speed of the die roll LO. Since the pump 50 is a plunger type having many mechanical parts in construction, it has a problem or limits in the speeding up.

Particularly, since the capsule pockets 11 are formed to arrange at an equal interval in the circumferential direction of each die roll 10, the number of capsule pockets having less filling amount and arranged in the circumferential direction becomes larger than the number of those having large filling amount, so that even if the rotational speed of the die roll 10 is low, the pump 50 is required to have a relatively high driving speed. Accordingly, the die roll 10 having many capsule pockets in the circumferential direction has a serious problem that it is hardly possible to speed up the rotational speed of the die roll 10 in view of the limits of performance of the pump 50.

(5) If the driving speed of the pump 50 increases, the filling accuracy is lowered, causing a problem of the deterioration of the soft capsules.

(6) When the rotational speed of the die roll 10 and the driving speed of the pump 50 respectively increase, a mechanical load applied to the apparatus increases, causing a problem that a trouble is liable to occur so that the apparatus can not be used for a long period of time.

(7) Although it is possible to increase the number of capsule pockets in the axial direction using the die roll 10 having a long axis, it causes a problem that the entire apparatus as well as the die roll per se costs high.

Under the circumstances having the various problems, the inventor of this application endeavored himself to improve the productivity and to study the cause of the generation of the remaining gelatin sheet 101 that is consumed in vain or wasted, then he has found out that two gelatin sheets 100, 100 are firmly bonded to each other at each edge of the traces of capsules (holes) of the remaining gelatin sheet 101 from which the soft capsules 200 are cut.

The inventor experimentally manufactured the soft capsules using a die roll having a single blade between two capsule pockets, namely, using the die roll having a single blade that is shared by adjacent capsule pockets. As a result, it has been found that there is no problem if the driving speed of the pump 50, the rotational speed of the die rolls 10, 10 and the shape of the curved surfaces that are opened to form the nozzle holes 22 of the nozzle segment 20 are optimally adjusted, and also found that the remaining gelatin sheet causing the machine trouble can be sharply reduced.

SUMMARY OF THE INVENTION

The present invention has been made in view of the aforementioned problems, and it has an object to provide a die roll having many capsule pockets in high density wherein a single blade is shared by two adjacent capsule pockets, and it has another object to provide a method for manufacturing soft capsules by combining the die roll having many capsule pockets in high density with a nozzle segment having nozzle holes provided in two rows wherein a filing material is supplied at a time to capsule pockets arranged in two rows on the die roll by actuating or driving the plunger type pump one time (one stroke).

To achieve the above object, die rolls of a soft capsule manufacturing apparatus according to a first aspect of the invention comprises a pair of die rolls that are close to and confront each other, each die role having capsule pockets in a plurality of rows on an outer peripheral surface thereof, and a nozzle segment having an inverse mountain-like projection for supplying a filling material, said inverse mountain-like projection having curved faces that are positioned in confronting relation with each other at right and left sides about the lower end central portion thereof, said curved faces having nozzle holes, wherein the inverse mountain-like projection confronts a curved recess that is surrounded by curved peripheral surfaces of die rolls at the upper sides thereof, and wherein two gelatin sheets are supplied between the die rolls from the upper portion thereof to receive the filling material therein corresponding to the capsule pockets of each die roll to manufacture soft capsules, wherein each die roll has blades that are shared by adjacent capsule pockets.

A method of manufacturing soft capsules according to a second aspect of the invention using die rolls of a soft capsule manufacturing apparatus according to the first aspect of the invention comprising a pair of die rolls that are close to and confront each other, each die role having capsule pockets in a plurality of rows on an outer peripheral surface thereof, a nozzle segment having an inverse mountain-like projection for supplying a filling material, said inverse mountain-like projection having curved faces that are positioned in confronting relation with each other at right and left sides about the lower end central portion thereof, said curved faces having nozzle holes, wherein the inverse mountain-like projection confronts a curved recess that is surrounded by curved peripheral surfaces of the die rolls at the upper sides thereof, and wherein two gelatin sheets are supplied between the die rolls from the upper portion thereof to receive the filling material therein corresponding to the capsule pockets of each die roll to manufacture soft capsules, wherein the method comprises providing blades on each die roll so as to be shared by the adjacent capsule pockets on each die roll, arranging said nozzle holes on said curved faces of the nozzle segment in a plurality of rows corresponding to the capsule pockets provided on each die roll in a plurality of rows, and supplying the filling material at a time from the nozzle holes in a plurality of rows corresponding to the capsule pockets provided on each die roll in a plurality of rows.

PREFERRED EMBODIMENT OF THE INVENTION

Figure 1:
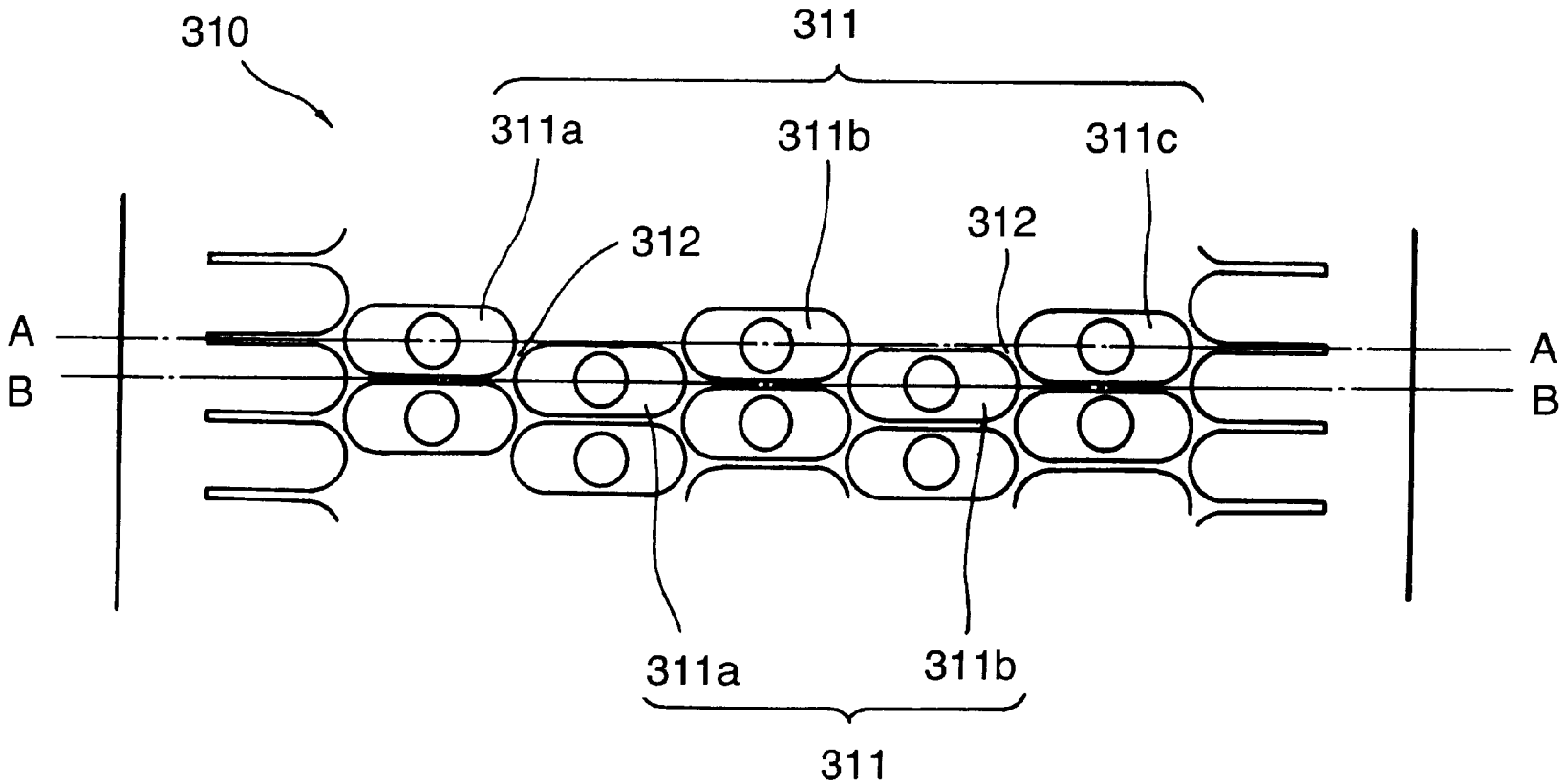
FIG. 1 is a side view showing a part of an example of a die roll employed by a soft capsule manufacturing apparatus of the invention.
Figure 10:
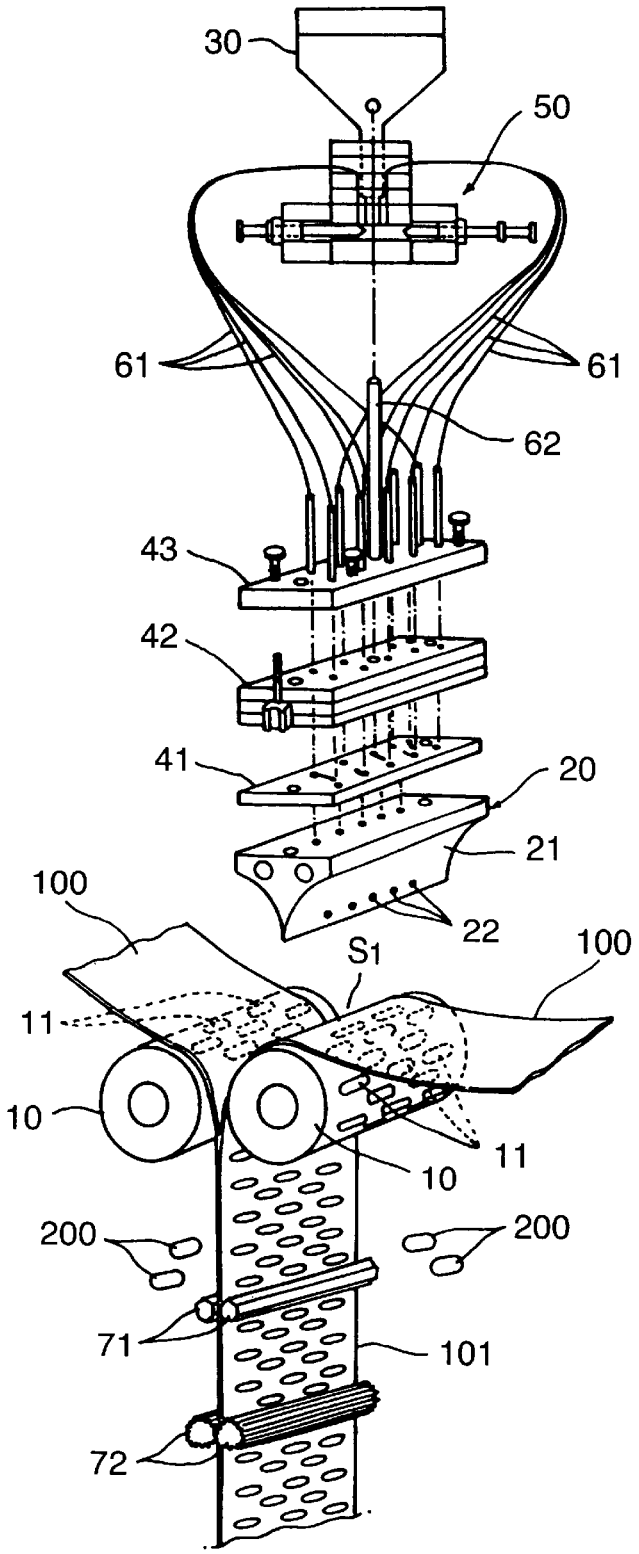
FIG. 10 (PRIOR ART)
FIG. 10 is an exploded view showing a diagrammatic construction of a main part of a soft capsule manufacturing apparatus that is used generally.
Figure 11:
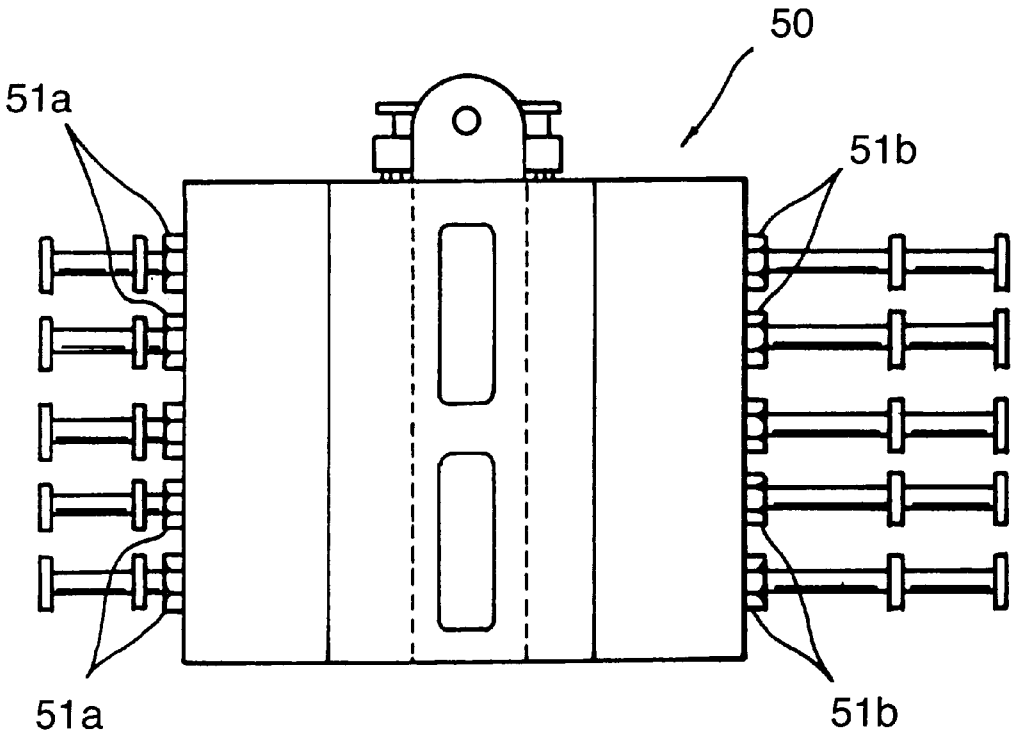
FIG. 11 (PRIOR ART)
FIG. 11 is a plan view showing a state where a supply hopper of a plunger type pump and a tube connecting part positioned under the supply hopper of the soft capsule manufacturing apparatus n FIG. 10 are removed.
Figure 12:
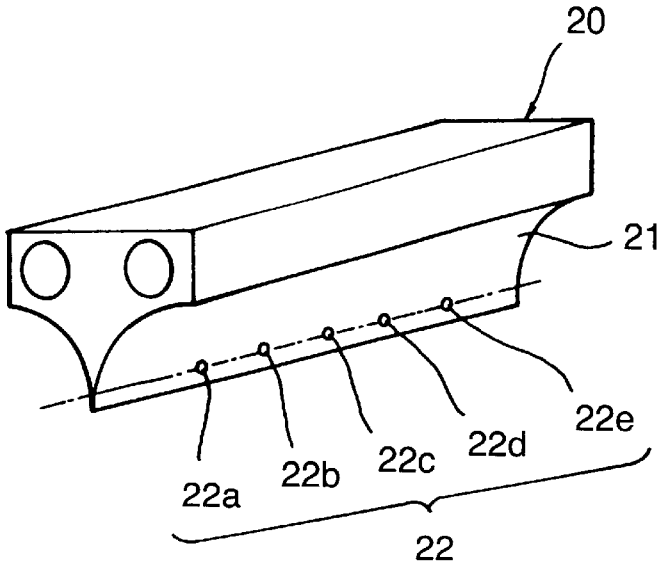
FIG. 12 (PRIOR ART)
FIG. 12 is a perspective view of a nozzle segment of the soft capsule manufacturing apparatus in FIG. 10.
Figure 13:
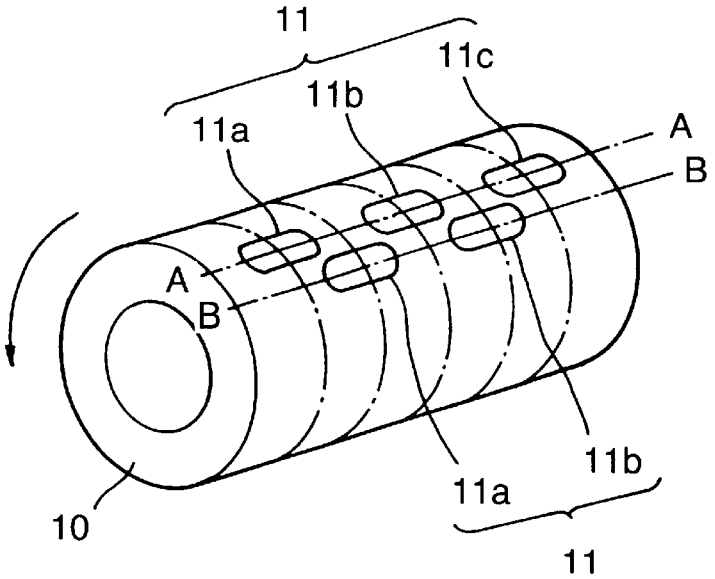
FIG. 13 (PRIOR ART)
FIG. 13 is a perspective view of a die roll of the soft capsule manufacturing apparatus in FIG. 10.

A soft capsule manufacturing apparatus according to the preferred embodiment of the invention will be first described. FIG. 1 is a view showing an example of a die roll employed by the soft capsule manufacturing apparatus according to the invention. Components other than the die rolls of the soft capsule manufacturing apparatus are substantially the same as those in the conventional soft capsule manufacturing apparatus shown in FIG. 10.

Figure 14:
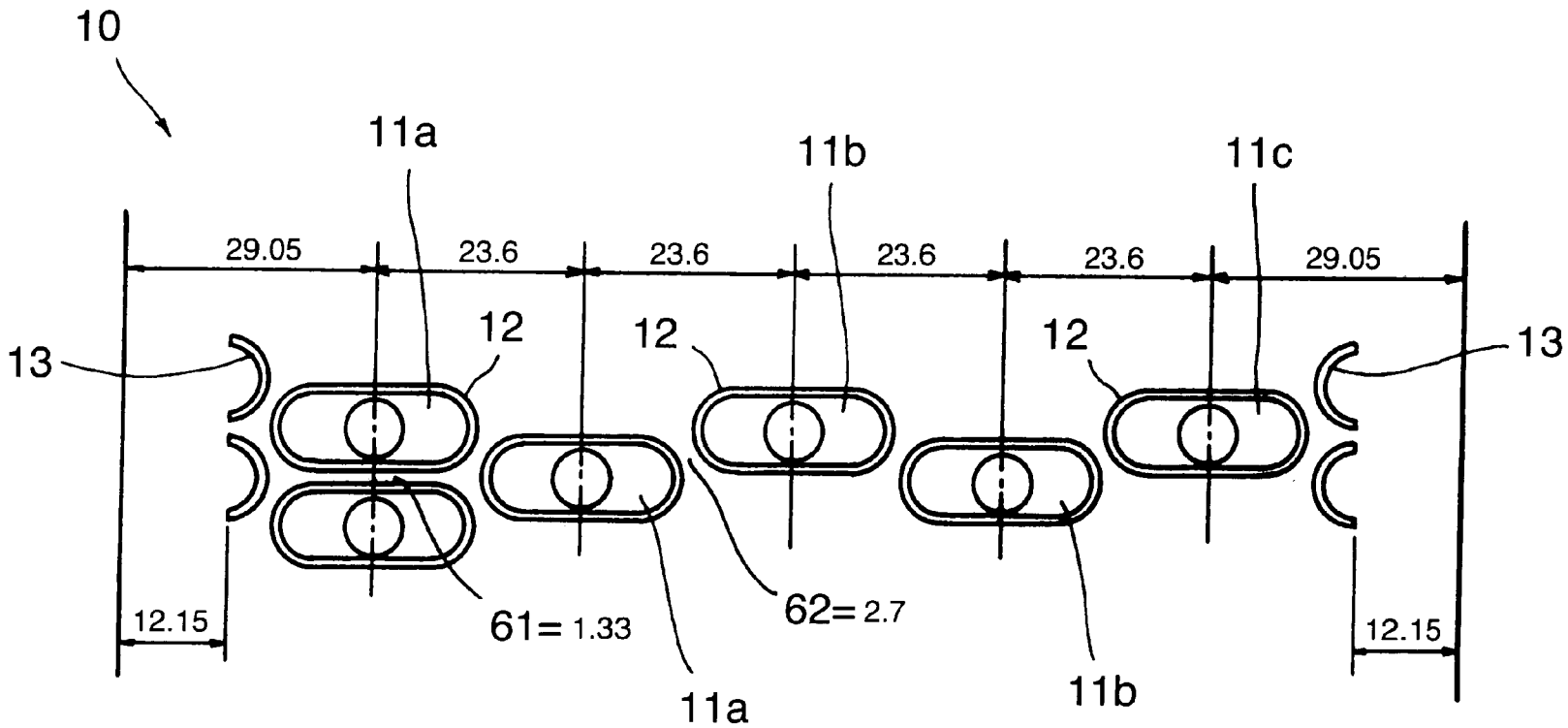
FIG. 14 (PRIOR ART)
FIG. 14 is a side view showing a standard data of the die roll employed by the soft capsule manufacturing apparatus in FIG. 10.
Figure 15:
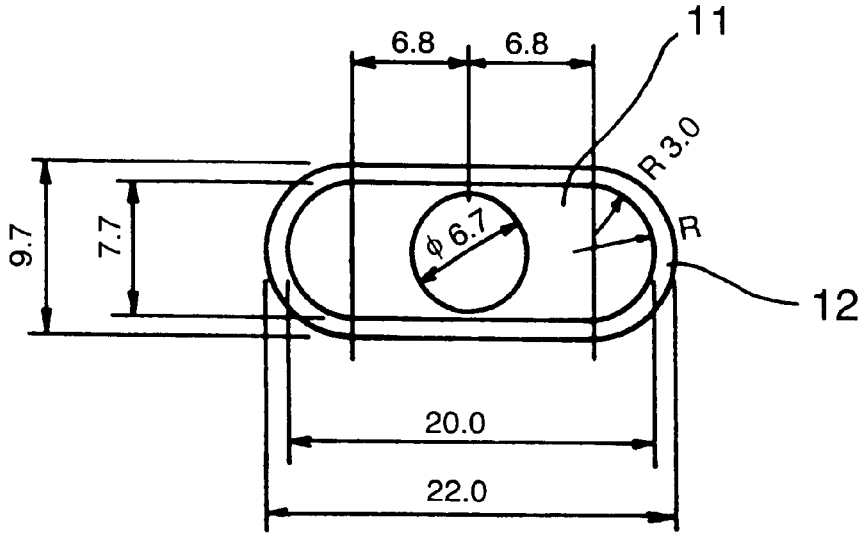
FIG. 15 (PRIOR ART)
FIG. 15 is an enlarged side view showing the capsule pocket provided on the die roll in FIG. 14.
Figure 16:
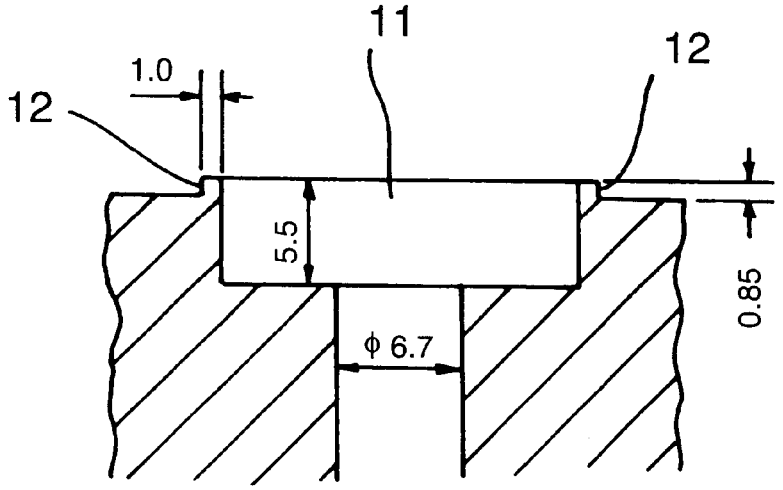
FIG. 16 (PRIOR ART)
FIG. 16 is an enlarged longitudinal sectional view showing the capsule pocket provided on the die roll in FIG. 14.

The die roll 310 has three elliptical capsule pockets 311 (311*a*, 311*b* and 311*c*) arranged in the row denoted by A—A and two elliptical capsule pockets 311 (311*a* and 311*b*) arranged in the row denoted by B—B that are repeated in the circumferential direction thereof. Each blade 312 of the capsule pockets 311 is shared by the adjacent capsule pockets 311, and hence the gaps 61 and 62 as defined between the capsule pockets 11, 11 of the conventional each die roll 10 shown in FIGS. 14 to 16 are not present between the capsule pockets 311, 311.

Figure 2:
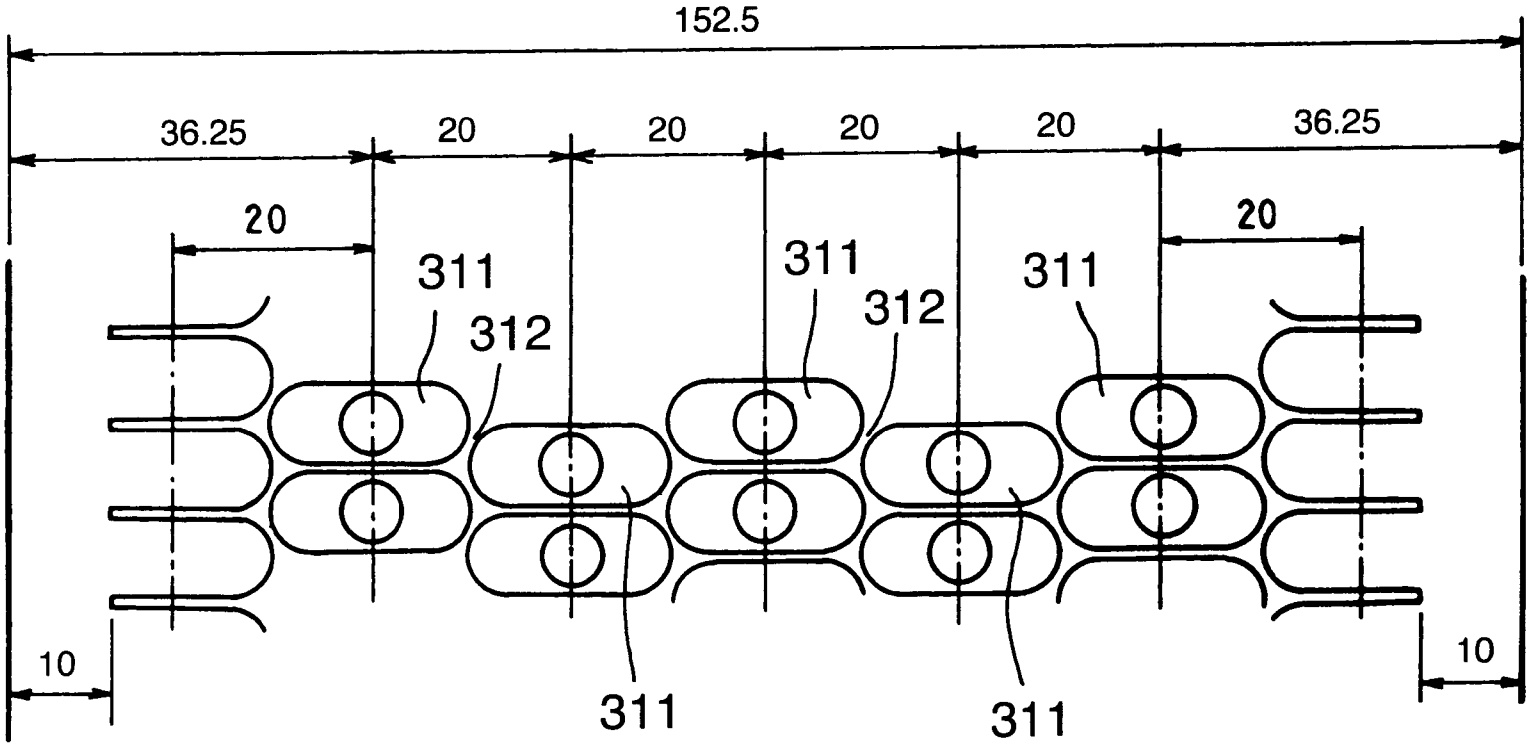
FIG. 2 is a side view showing a standard data of the die roll in FIG. 1.
Figure 3:
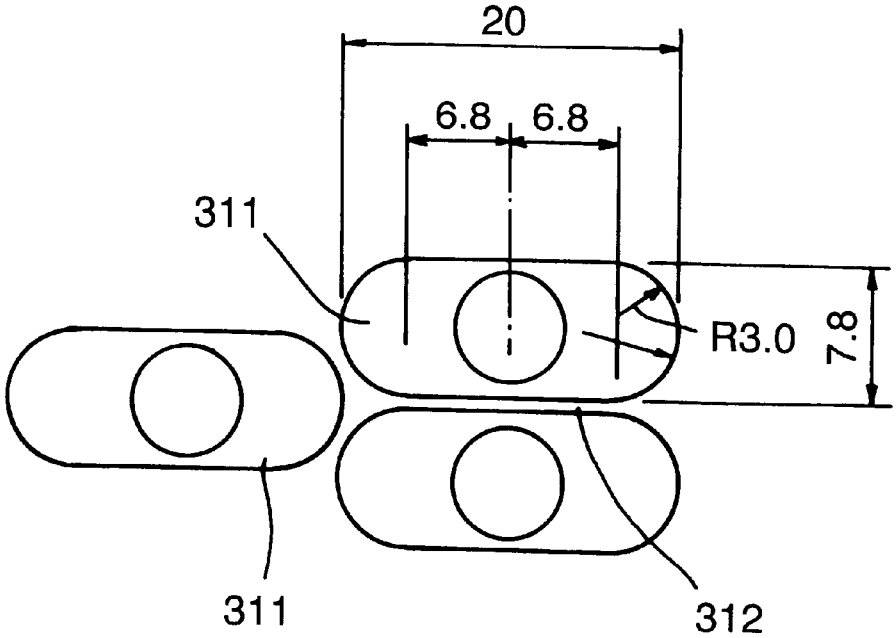
FIG. 3 is an enlarged side view showing the arrangement of the capsule pockets provided on the die roll in FIG. 1.
Figure 4:
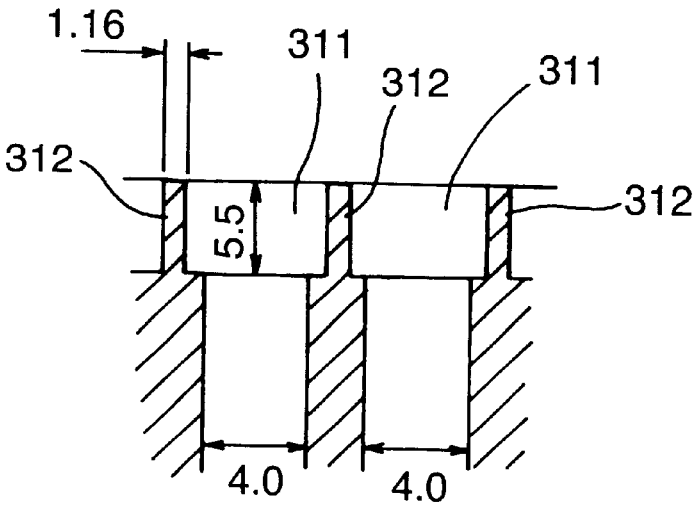
FIG. 4 is an enlarged longitudinal sectional view showing the parts of the capsule pockets provided on the die roll in FIG. 1.

Accordingly, in the case of the die roll 310 having the standards as shown in FIGS. 2 to 4, the die roll 310 has a diameter of 102.8 mm and the length of axis is 152.5 mm. If the capsule pockets 311 have substantially the same size, the die roll 310 can be divided into 36, and hence the number of capsule pockets becomes 180 obtained by the expression of (three rows+two rows=five rows)×36, thereby sharply increasing the number of capsule pockets by about 1.24 times.

Accordingly, if a pair of die rolls 310, 310 are employed by the soft capsule manufacturing apparatus, it is possible to automatically obtain the capsule pockets that are 1.24 times as large as those manufactured by the conventional soft capsule manufacturing apparatus even if each die roll 310 has the same rotational speed as the conventional die roll, thereby remarkably improving the productivity of the soft capsules.

Since the remaining gelatin sheet 101 forms soft capsules at the region where the capsule pockets 311 on the die rolls 310, 310 are arranged, it is generated at the portion close to both edges of the die rolls 310, 310. As a result, the amount of remaining gelatin sheet respective to the amount of gelatin sheets 100, 100 is about 10%, and hence it can be sharply reduced compared with the conventional case where it is 35 to 45% relative to the amount of gelatin sheets 100, 100.

Figure 5:
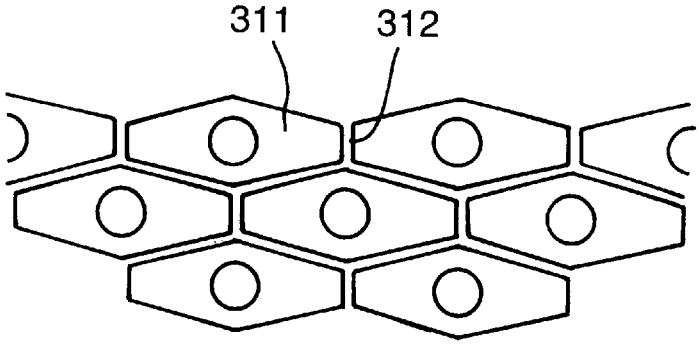
FIGS. 5(A), 5(B) and 5(C) are views for explaining some shapes of the capsule pockets provided on another example of the die roll employed by the soft capsule manufacturing apparatus of the invention.
Figure 5:
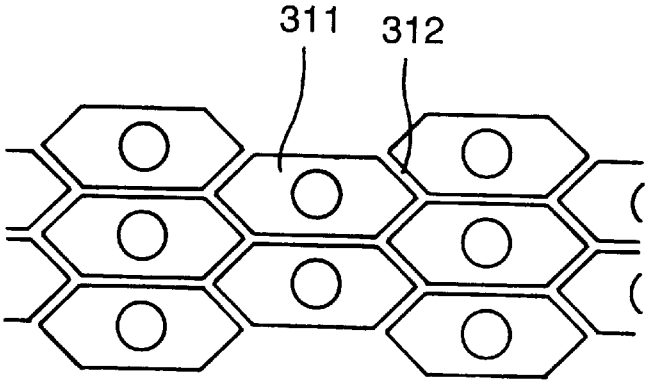
Figure 5:
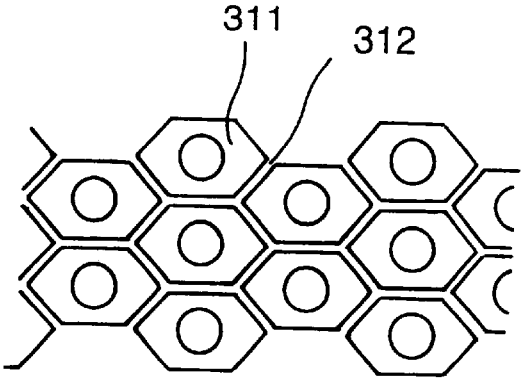
Figure 6:
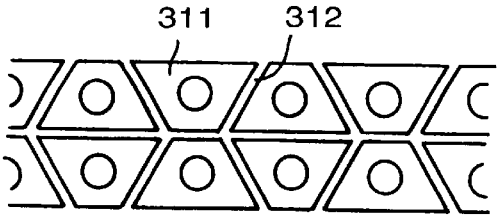
FIGS. 6(A), 6(B), 6(C) and 6(D) are views for explaining some shapes of the capsule pockets provided on still another example of the die roll employed by the soft capsule manufacturing apparatus of the invention.
Figure 6:
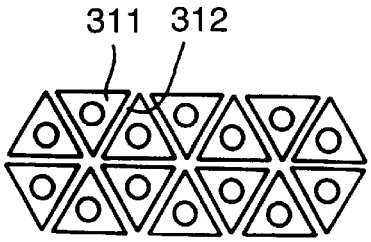
Figure 6:
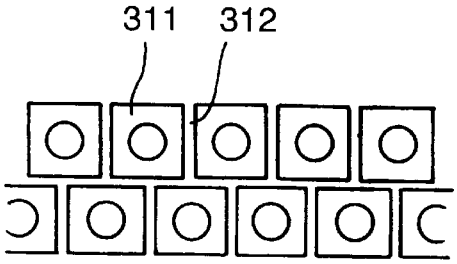
Figure 6:
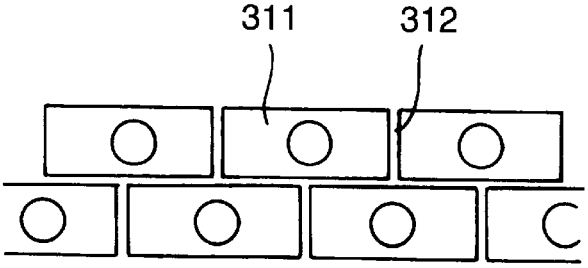

As the shape of the capsule pocket 311, each capsule pocket is not limited to the elliptical one as set forth above, but it may have various shapes such as hexagonal (FIGS. 5(A), 5(B), 5(C)), trapezoidal (FIG. 6(A), triangular (FIG. 6(B)), square (FIG. 6(C)), rectangular (FIG. 6(D)) or the like.

The die rolls 310, 310 employed by the invention has many capsule pockets, leading to the remarkable improvement of the productivity even if they are used by the conventional soft capsule manufacturing apparatus. However, if the die rolls 310, 310 are combined with the method of manufacturing capsule pockets as shown in FIGS. 7 to 9, the productivity can be more enhanced.

Figure 7:
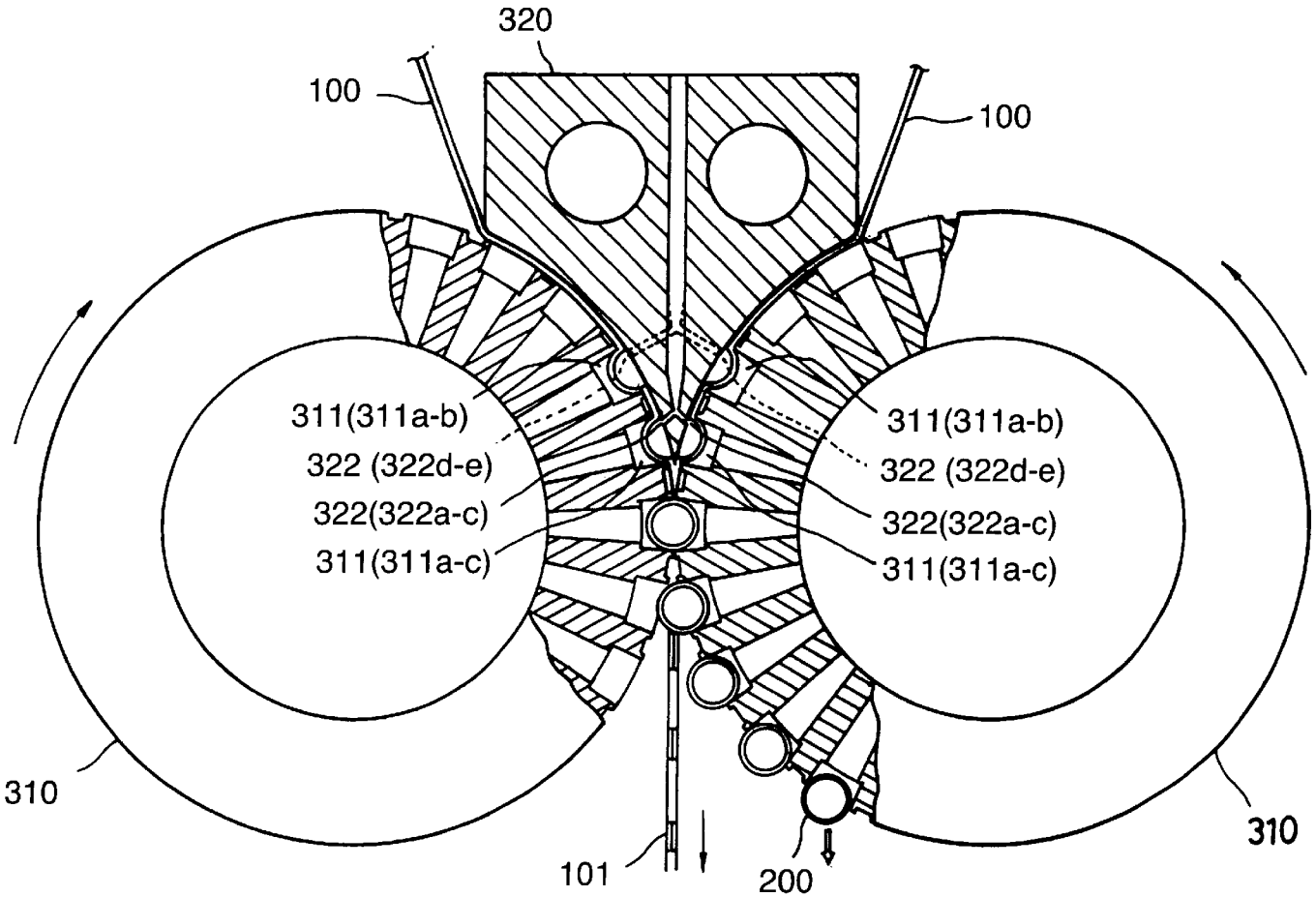
FIG. 7 is a longitudinal sectional view showing a state where a nozzle segment and a pair of die rolls are close to or grapple with one another in an apparatus that carries out a method of manufacturing the soft capsules according to the invention.
Figure 8:
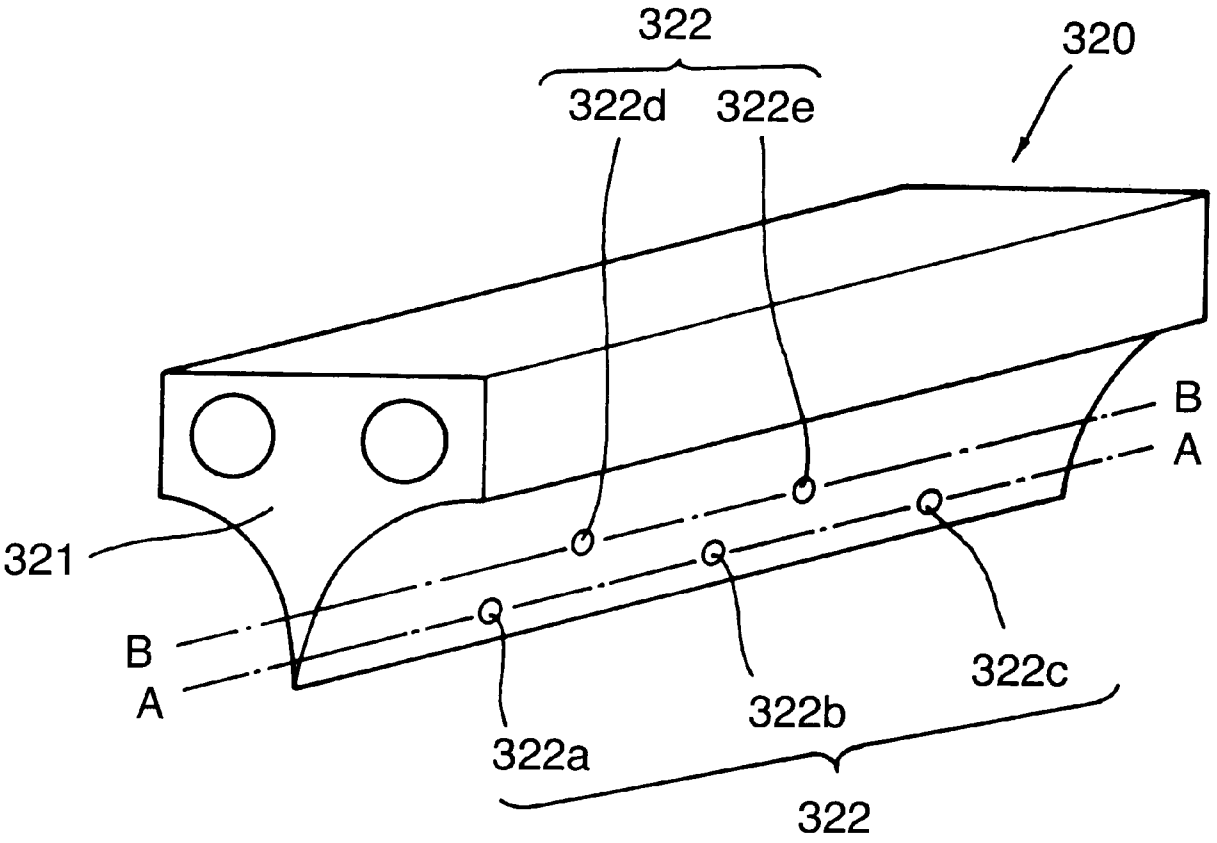
FIG. 8 is a perspective view of the nozzle segment of the soft capsule manufacturing apparatus i FIG. 7.

In the soft capsule manufacturing apparatus for carrying out the method of manufacturing the soft capsules according to the present invention, the nozzle segment 320 has a plurality of nozzle holes 322 provided at right and left curved surfaces thereof, positioned close to the lower end central portion of an inversed mountain-like projection 321 and arranged in two rows in the longitudinal direction thereof as shown in FIG. 7. This is typically concretely shown in FIG. 8 wherein there are, for example, three nozzle holes 322*a*, 322*b* and 322*c* along the row denoted by the line A—A close to the lowermost end of the inversed mountain-like projection 321 while there are, for example, provided two nozzle holes 322*d* and 322*e* along the row denoted by the line B—B close to and slightly over the row denoted by the line A—A. These nozzle holes 322*a*, 322*b* and 322*c* and nozzle holes 322*d* and 322*e* are also provided at the opposite curved surface.

Figure 9:
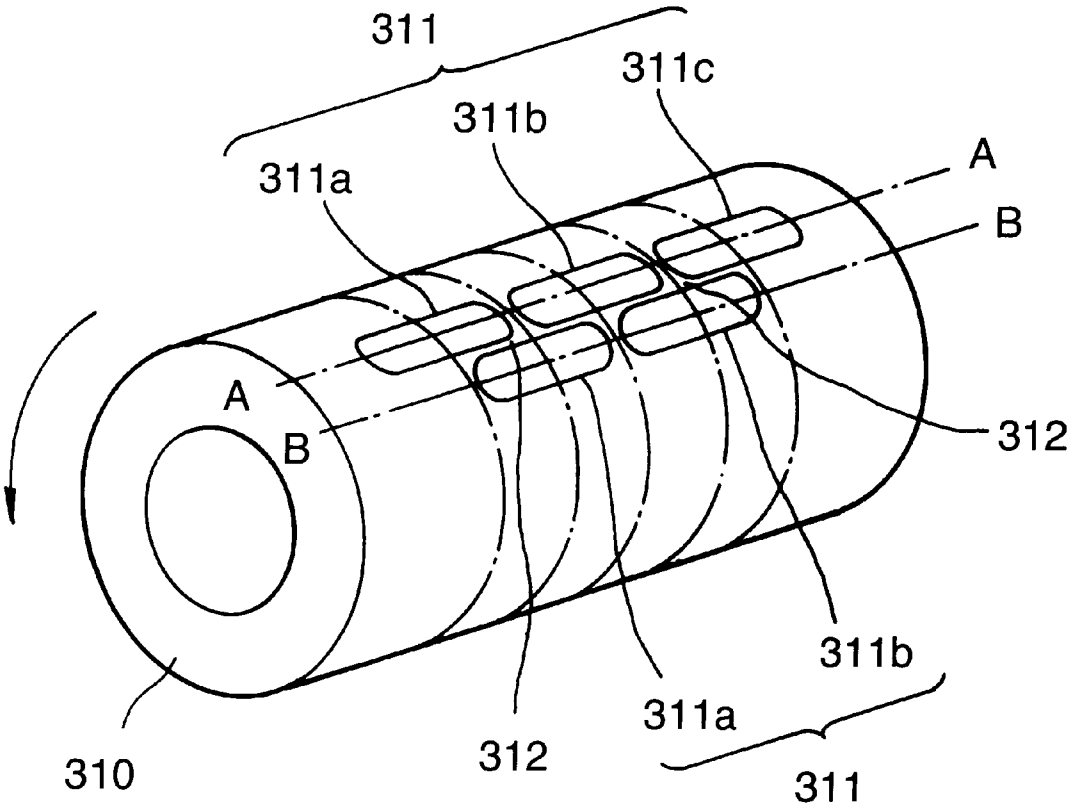
FIG. 9 is a perspective view of the die roll of the soft capsule manufacturing apparatus in FIG. 7.

The three nozzle holes 322*a*, 322*b* and 322*c* correspond to three capsule pockets 311*a*, 311*b* and 311*c* provided on the right die roll 310 shown in FIG. 9 arranged along the row denoted by the line A—A while the two nozzle holes 322*d* and 322*e* correspond to two capsule pockets 311*a* and 311*b* provided on the right die roll 310 arranged along the row denoted by the line B—B. The relation between the capsule pockets and nozzle holes in the left die roll 310 is the same as that in the right die roll 310.

Accordingly, when the soft capsules are manufactured using the soft capsule manufacturing apparatus, for example, a plunger type pump 50 is actuated to drive all the right and left plurality of cylinders 51*a*, 51*b* (respectively five pieces) wherein three of five cylinders are driven to discharge the filing material through the nozzle holes 322*a*, 322*b* and 322*c* of the nozzle segment 320 to supply the filling material to the gelatin sheets 100, 100 corresponding to the capsule pockets 311*a*, 311*b* and 311*c* arranged along the row denoted by the line A—A of the die roll 310 while two of five cylinders are driven to discharge the filling material from the nozzle holes 322*d* and 322*e* of the nozzle segment 320 to supply the filing material to the gelatin sheets 100, 100 corresponding to two capsule pockets 311*a* and 311*b* arranged along the row denoted by the line B—B of the die roll 310.

Thereafter, when the two gelatin sheets 100, 100 are conveyed downward and passed through the narrowest portion between the die rolls 310, 310 during the rotation of the die rolls 310, 310, they are instantaneously brought into intimate contact with each other. At the same time, when the annular blades that are formed at the peripheries of the capsule pockets 311 of the die rolls 310, 310 mesh with each other, the gelatin sheets 100, 100 are cut and they are pressed against and bonded to each other to form soft capsules 200. Also in this case, the remaining gelatin sheet is generated in a tape shape only at the portion close to both edges of each die roll 310, as a matter of course.

In this case, when the pump 50 is actuated one time (one stroke), the filling material is supplied at a time from the nozzle holes 322*a*, 322*b* and 322*c* and the nozzle holes 322*d* and 322*e* arranged in two rows of the curved surfaces of the inverse mountain-like projection 321 of the nozzle segment 320 to the capsule pockets 311*a*, 311*b* and 311*c* and the capsule pockets 311*a* and 311*b* arranged in two rows of the die roll 310. In other words, the rotational speed of each die roll 310 can be eventually doubled even if the driving speed of the pump 50 remains slow (even in the conventional speed), thereby realizing a large amount of production of the capsule pockets (double per hour). Accordingly, it is possible to sharply increase the number of soft capsules provided on the die roll, and sharply increase the amount of production of the soft capsules owing to the double speed of the rotational speed of the die rolls (e.g., provided that the number of capsule pockets=1.2 to 1.4 times multiplied by rotational speed (2 times), it becomes 2.4 to 2.8 times as large as the number of conventional capsule pockets.

Further, it is possible to achieve the remarkable increase of the production of the capsule pockets by merely providing the nozzle holes 322*a*, 322*b* and 322*c* and the nozzle holes 322*d* and 322*e* in two rows at the nozzle segment 320 while the standard such as the size of each die roll 310 and the size of nozzle segment 320 remains as it is, namely, even if each die roll 310 and the nozzle segment 320 employ the conventional standards. It is needless to say that the cylinders are needed by the number corresponding to the number of capsule pockets provided on each die roll 310 in the rows denoted by the line A—A and the line B—B. The distributor 41 and the slide valve mechanism 42 may be easily exchanged with others, because these elements are inherently exchangeable parts.

Particularly, in the case of the method of manufacturing soft capsules according to the invention, since the filling material is supplied at a time to the capsule pockets provided at the die roll in two rows, it is preferable that the interval between capsule pockets in each row is small in view of the prevention of leakage of filling material. In this respect, the die roll 310 of the invention has the blade 312 that is shared by the adjacent capsule pockets 311, 311, and hence the interval between the capsule pockets is very small, thereby achieving optimal combination between the capsule pockets 311, 311 and the blade 312.

As is evident from the foregoing, there are following effects obtained by die rolls of the soft capsule manufacturing apparatus and the method of manufacturing the soft capsules of the present invention.

(1) First, since the blades of many capsule pockets that are arranged in the outer peripheral surface of each die roll are respectively shared by the adjacent capsule pockets, it is possible to sharply increase the number of capsule pockets, thereby improving the remarkable productivity.

(2) Further, it is possible to sharply reduce the amount of remaining gelatin sheet since the remaining gelatin sheet is merely generated in a tape shape at the portion close to both edges of each die roll owing to the die roll having the capsule pockets provided in high density and having each blade shared by the adjacent capsule pockets. More concretely, in the conventional die rolls, the amount of the remaining gelatin sheet relative to all the amount of the gelatin sheets 100, 100 has been normally 35 to 45%, it has however become 10%. As a result, it can solve the problem of the wasting of the gelatin sheets, leading to sharp reduction of the wasting cost.

(3) Still further, it is possible to solve the problem of the winding of the remaining gelatin sheet around the die rolls, strip rolls and mangle rolls because it is merely generated in a tape shape at the portion close to both edges of the die roll, thereby assuring the stable operation without producing machine troubles, leading to the improvement of productivity. Further, there is an advantage that parts such as strip rolls are dispensed with.

(4) More still further, since the filling material is supplied at a time to the capsule pockets arranged in two rows on each die roll when the plunger type pump is actuated one time (one stroke) by combining each die roll having capsule pockets provided in high density and having each blade shared by the adjacent capsule pockets and the nozzle segment having the nozzle holes arranged in two rows, the rotational speed of each die roll is eventually doubled even if the driving speed of the plunger type pump remains slow, thereby further improving the productivity.

(5) Considering limits in the speeding up of the pump because of many mechanical parts thereof, there is an advantage that the invention can use such a pump since the driving speed of the plunger type pump remains slow.

Particularly, the advantage set forth above has solved the problem of the rotational speed of the die roll which has many capsule pockets in the circumferential direction and which has been difficult to be speeded up so far owing to the limits of the driving speed of the conventional plunger type pump.

(6) Further, the fact that the plunger type pump remains slow and driving speed contributes to the filling accuracy, thereby enhancing the quality of each capsule pocket.

(7) Still further, the fact that the rotational speed of the die roll is doubled while the driving speed of the plunger type pump remains slow allows the margin to the setting between the driving speed of the pump and the rotational speed of the die roll (the driving speed of the pump can be halved, for example, if the rotational speed of the die roll is the same as the conventional speed), so that a mechanical load or burden applied to the apparatus can be reduced. As a result, the apparatus can be prevented from trouble in advance, and the apparatus can be used for a long period time to assure the long life of the apparatus.

(8) Still further, in case that the driving speed of the plunger type pump is halved while the rotational speed of the die roll is the same as the conventional one, the apparatus can cope with a filling material (having a high viscosity) which has been heretofore not filled because of high resistance at the sliding parts of the conventional pump and nozzle holes of the conventional nozzle segment.

(9) Finally, the invention can be worked in a state where a standard such as a size of the die roll or the size of the nozzle segment is fundamentally the same as the conventional one and a slight change is made in the nozzle segment, namely, the nozzle holes are provided in two rows. Further, if the invention employs the plunger type pump, the distributor and the slide valve mechanism, the invention has an advantage that it can cope with such employment by a partial exchange therebetween.

What is claimed is:

1. A soft capsule manufacturing apparatus comprising a pair of die rolls that are close to and confront each other, each of the die rolls having capsule pockets in a plurality of rows on an outer peripheral surface thereof, and a nozzle segment having a projection for supplying a filling material, said projection having curved faces that are positioned in opposite relation with each other at right and left sides about a lower end thereof, said curved faces having nozzle holes, wherein the projection confronts a curved recess that is surrounded by curved peripheral surfaces of the die rolls at upper sides thereof, and wherein two gelatin sheets are supplied between the die rolls from an upper portion thereof to receive the filling material through the nozzle holes of the projection corresponding to the capsule pockets of each of the die rolls to manufacture soft capsules, wherein each of the die rolls includes blades that are shared by and disposed between adjacent ones of the capsule pockets, a width of each said blade being narrower than each said capsule pocket, wherein the two gelatin sheets used as a coating for the soft capsules are joined by the die rolls to form the soft capsules and combined tape-shaped gelatin strips are formed along opposite edge portions of the gelatin sheets and discharged from the die rolls, wherein said blades extend about the entirety of said capsule pockets and at least one of said capsule pockets shares the entirety of its said corresponding blade with adjacent ones of said capsule pockets.

2. The soft capsule manufacturing apparatus of claim 1, wherein two of said adjacent ones of said capsule pockets are positioned at opposing axial sides of said at least one capsule pocket to share portions of said blade of said at least one capsule pocket.

3. The soft capsule manufacturing apparatus of claim 1, including a pump for driving the filling material through the nozzle holes to fill the capsule pockets.

4. A method of manufacturing soft capsules using a soft capsule manufacturing apparatus comprising a pair of die rolls that are close to and confront each other, each of the die rolls having capsule pockets in a plurality of pocket rows on an outer peripheral surface thereof, a nozzle segment having a projection for supplying a liquid medicine, said projection having curved faces that are positioned in opposite relation with each other at right and left sides about a lower end thereof, said curved faces having nozzle holes, wherein the projection confronts a curved recess that is surrounded by curved peripheral surfaces of the die rolls at upper sides thereof, and wherein two gelatin sheets are supplied between the die rolls from an upper portion thereof to receive the liquid medicine therein corresponding to the capsule pockets of each of the die rolls to manufacture soft capsules, said method comprising:

providing blades on each of the die rolls so as to be shared by the adjacent capsule pockets on each of the die rolls;

arranging said nozzle holes on said curved faces of the projection of the nozzle segment in first and second nozzle rows corresponding to the capsule pockets provided on each of the die rolls in the plurality of pocket rows, the nozzle holes in the second nozzle row being displaced toward the upper side between the nozzle holes in the first nozzle row; and supplying the liquid medicine from the nozzle holes in the first and second nozzle rows to the capsule pockets provided on each of the die rolls in the plurality of pocket rows with a plunger type pump.

5. The method according to claim 4, wherein the blades and the capsule pockets are respectively arranged in the plurality of pocket rows about the entirety of each of said die rolls.

6. The method of manufacturing soft capsules of claim 4, including the steps of:

joining the two gelatin sheets to encapsulate the liquid medicine in soft capsules and to form combined tape-shaped gelatin strips along opposite edge portions of the gelatin sheets with the die rolls; and discharging the combined tape-shaped gelatin strips from the die rolls.

7. The method of manufacturing soft capsules of claim 4, wherein the step of providing the blades on each of the die rolls includes providing blades extending about the entirety of the capsule pockets, and wherein at least one of the capsule pockets shares the entirety of the corresponding blade with adjacent ones of the capsule pockets.

8. The method of manufacturing soft capsules of claim 7, wherein at least two of the adjacent ones of the capsule pockets are positioned at opposing axial sides of the at least one capsule pocket to share portions of the blade of the at least one capsule pocket.

9. A method of manufacturing soft capsules in a soft capsule manufacturing apparatus comprising first and second die rolls that are close to and confront each others each of the die rolls having capsule pockets in a plurality of rows, a nozzle segment having a tapering downward projection forming a lower end of the nozzle segment with first and second faces positioned in opposite relation with each other about the lower end, each of said faces having at least one row of nozzle apertures, wherein the first face of the nozzle segment is positioned adjacent a portion of the first die roll and the second face of the nozzle segment is positioned adjacent a portion of the second die roll, the at least one row of apertures of the first and second die rolls corresponding to the capsule pockets formed in the first and second die rolls, the method comprising the steps of:

providing blades on each of the die rolls so that portions of the blade for at least one of the capsule pockets are shared at least by axially adjacent ones of the capsule pockets at opposing axial sides of the at least one capsule pocket;

feeding gelatin sheets between the first die roll and the first face and the second die roll and the second face of the nozzle segment to form soft capsules and combined tape-shaped gelatin strips;

applying filling material through the plurality of nozzle apertures of the first and second faces onto the gelatin sheets overlying the die rolls at positions having respective ones of the capsule pockets; and discharging the tape-shaped gelatin strips from the die rolls;

wherein providing the blades so that portions of the blades are shared decreases the amount of the gelatin sheets that is wasted and the step of providing said blades on each of the die rolls includes providing the blades to extend about the entirety of said capsule pockets and at least one of said capsule pockets sharing the entirety of the corresponding blade with adjacent ones of said capsule pockets.

10. The method of manufacturing soft capsules of claim 9, wherein the step of applying the filling material onto the gelatin sheets overlying the die rolls includes driving the filling material through the nozzle apertures during each stroke of a pump.

11. The method of manufacturing soft capsules of claim 9, wherein the row of nozzle apertures for each of the faces comprises one of a plurality of rows of nozzle apertures.

12. The method of manufacturing soft capsules of claim 9, wherein the step of applying filling material through the plurality of nozzle apertures comprises applying a liquid medicine through the plurality of nozzle apertures.

* * * * *